US007699007B2

(12) United States Patent
Miller et al.

(10) Patent No.: US 7,699,007 B2
(45) **Date of Patent: *Apr. 20, 2010**

(54) GUIDEWAY CARRIER AND MAGNETIC LEVITATION RAILWAY MANUFACTURED THEREWITH

(75) Inventors: Luitpold Miller, Ottobrunn (DE); Werner Hufenbach, Dresden (DE); Qinghua Zheng, Taufkirchen (DE); Klaus Kunze, Dresden (DE); Gerhard Eckart, Dreseden (DE)

(73) Assignee: ThyssenKrupp Transrapid GmbH, Kassel (DE)

( * ) Notice: Subject to any disclaimer, the term of this patent is extended or adjusted under 35 U.S.C. 154(b) by 64 days.

This patent is subject to a terminal disclaimer.

(21) Appl. No.: 11/579,312

(22) PCT Filed: Jun. 9, 2005

(86) PCT No.: PCT/DE2005/001030

§ 371 (c)(1),
(2), (4) Date: Nov. 1, 2006

(87) PCT Pub. No.: WO2005/121454

PCT Pub. Date: Dec. 22, 2005

(65) Prior Publication Data

US 2009/0020033 A1 Jan. 22, 2009

(30) Foreign Application Priority Data

Jun. 14, 2004 (DE) ..... 10 2004 028 948

(51) Int. Cl.
*B60L 13/04* (2006.01)

(52) U.S. Cl. ..... 104/281; 104/259

(58) Field of Classification Search ..... 104/124, 104/281, 259, 134, 135, 260

See application file for complete search history.

(56) References Cited

U.S. PATENT DOCUMENTS

| | | | | | |
|---|---|---|---|---|---|
| 3,797,402 | A | * | 3/1974 | Karch | 104/130.02 |
| 3,937,148 | A | * | 2/1976 | Simpson | 104/283 |
| 3,979,402 | A | * | 9/1976 | Newberry et al. | 548/204 |
| 4,856,173 | A | * | 8/1989 | Maier et al. | 29/445 |
| 5,027,713 | A | * | 7/1991 | Kindmann et al. | 104/124 |
| 5,140,208 | A | * | 8/1992 | Tozoni | 310/90.5 |
| 5,267,091 | A | * | 11/1993 | Chen | 359/872 |
| 5,511,488 | A | * | 4/1996 | Powell et al. | 104/282 |
| 5,649,489 | A | * | 7/1997 | Powell et al. | 104/282 |

(Continued)

FOREIGN PATENT DOCUMENTS

DE 2 021 834 3/1972

(Continued)

OTHER PUBLICATIONS

ZEV-GLAS. Ann 105, 1989, pp. 205-215.

(Continued)

*Primary Examiner*—S. Joseph Morano
*Assistant Examiner*—Jason C Smith
(74) *Attorney, Agent, or Firm*—Michael J. Striker

(57) ABSTRACT

A guideway carrier (11) and a magnetic levitation railway being produced therewith are described. The guideway carrier (11) has a gliding surface (14) for the gliding skids of the magnetic levitation railway. The gliding surface (14) is provided with a coating, which is applied by the use of a low-friction and low-wear ceramic material being adapted (matched) to the gliding skid material (FIG. 2).

13 Claims, 2 Drawing Sheets

U.S. PATENT DOCUMENTS

| | | | | |
|---|---|---|---|---|
| 6,085,663 | A * | 7/2000 | Powell et al. | 104/281 |
| 6,129,025 | A * | 10/2000 | Minakami et al. | 104/88.01 |
| 6,450,103 | B2 * | 9/2002 | Svensson | 104/120 |
| 6,820,946 | B2 * | 11/2004 | Salamat et al. | 303/122.09 |
| 6,916,075 | B2 * | 7/2005 | Salamat et al. | 303/112 |
| 6,951,372 | B2 * | 10/2005 | Salamat et al. | 303/112 |
| 7,198,817 | B2 * | 4/2007 | Takahashi et al. | 427/127 |
| 7,387,349 | B2 * | 6/2008 | Salamat et al. | 303/155 |
| 2003/0089581 | A1 * | 5/2003 | Thompson et al. | 198/619 |
| 2003/0104246 | A1 * | 6/2003 | Watanabe et al. | 428/692 |
| 2004/0096575 | A1 * | 5/2004 | Takahashi et al. | 427/128 |
| 2004/0144960 | A1 * | 7/2004 | Arai et al. | 252/500 |
| 2007/0034106 | A1 * | 2/2007 | Miller et al. | 104/286 |
| 2009/0020033 | A1 * | 1/2009 | Miller et al. | 104/281 |

FOREIGN PATENT DOCUMENTS

| | | |
|---|---|---|
| EP | 0 381 136 | 8/1990 |
| WO | 2004/085744 | 10/2004 |

OTHER PUBLICATIONS

"Magnetbahn Transrapid, Die Neue . . . " Hestra Verlag Darmstadt, 1989, pp. 21-23.

"Neue Verkehrstechnologien", Henschel Magnetfahrtechnik Jun. 1986.

* cited by examiner

GUIDEWAY CARRIER AND MAGNETIC LEVITATION RAILWAY MANUFACTURED THEREWITH

The invention relates to a guideway carrier and to a magnetic levitation vehicle manufactured therewith.

The guideways of magnetic levitation railways are composed of guideway carriers which are provided with so-called gliding surfaces, apart from the driving means destined for driving the vehicles and frequently designed and built as stator packs of long-stator linear motors as well as apart from the lateral guiding rails destined for tracking. In most cases, these gliding surfaces are mounted on the upper top surface of guideway carriers and both during a normal stoppage and in cases of emergency they serve for setting down the vehicles by the aid of gliding skids mounted at their undersides. The designations "gliding" surface and "gliding" skid are just meant to express that the gliding skids can be set down on the gliding surfaces not only during a standstill but also during the ride of the vehicles and can then be moved on them in a sliding mode until the vehicle comes to a standstill. For example, such a situation may occur in case of a failure of a carrying magnet, because in this case a pertinent section of the vehicle and/or of its levitating frame will sink down so far that the vehicle will set down with at least one gliding skid on the gliding surface. As a result thereof and in view of the high speeds achievable with magnetic levitation vehicles reaching 400 km/h and more, substantial friction energies are induced that entail high temperatures and intensive wear or tear in the area of the gliding partners concerned.

Up to now, little attention has been paid to the frictional conditions occurring in case of emergency set-downs. The gliding properties rather resulted more or less accidentally from the materials used for the gliding skids and gliding surfaces. It was assumed that the gliding surfaces are made of steel or concrete like the guideway carriers and that the gliding skids must be made of a material that is distinguished by a high resistance to abrasion compared with steel or concrete. In this context it is also known to configure the gliding surfaces at gliding strips made of steel and to provide them with corrosion protection coatings made of zinc dust and micaceous iron ore based upon epoxy resin and/or polyurethane.

In practical operation of magnetic levitation railways of the type as described hereunder, it turned out that gliding properties achieved in this manner fail to be sufficient for various reasons. In particular it might be desired not to perform a repair or maintenance on defective vehicles not instantly and anywhere along the guideway as soon as a defect occurs, but to let defective vehicles ride on, if possible, until they reach a shop suitable for repair and maintenance work. In such cases, however, the high frictional forces occurring in case of a failure of carrying magnets between hitherto known gliding skids and gliding surfaces would lead to high mechanical loads and temperatures, so that a safely reaching of the nearest repair shop without premature complete wear or tear of gliding skids and/or gliding surfaces could only be assured by installing these repair shops along the guideway at relatively short distances. If these distances between repair shops are too large, many defects affecting the vehicles would also cause damage to the gliding surfaces and therefore call for a repair of the relevant gliding surfaces and even to the entire guideway, which would entail substantial cost of operation, and which must therefore be avoided.

For avoidance of such problems, it has already been suggested to provide the gliding surfaces of the guideway carriers with polyurethane-acryl coatings at least in their outer areas, to which coatings a material that diminishes friction and wear or tear is admixed, e.g. graphite and/or polytetrafluoroethylene. However, by coatings of this type, the cost-intensive repair work as described before cannot be reduced sufficiently. Rather, practical tests showed that coatings of this type certainly lead to frictional values which are more favourable than those achieved to date but do not have adequate low-wear properties. In particular, this comes true if the guideway carriers are also used by maintenance and assembly vehicles, which is common practice, which utilize the gliding surfaces as guideways and which are frequently decelerated and accelerated, and/or if the gliding surfaces are at least partly covered with whirled-up sand or similar pollutants, which is unavoidable. A consequence hereof is that the coatings of the gliding surfaces, in particular, require cost-intensive maintenance or repair work.

SUMMARY OF THE INVENTION

Now, therefore, it is the object of the present invention to propose a configuration for the gliding surfaces of the species outlined hereinabove that improves not only the gliding properties of the gliding partners gliding surface/gliding skid, but that also low-wear coatings requiring little maintenance are obtained.

Since the gliding surfaces according to the present invention are provided with a coating made of ceramic material and/or ceramic hard (mechanically resistant) substances matched to the gliding skid material, the gliding properties can be so optimized that a magnetic levitation vehicle in case of a failure of a carrying magnet or the like and/or during setting-down of a skid can still run a comparably long distance without incurring a situation critical to the guideway and/or vehicle. The enlargement of distances thus becoming possible between the repair shops to be installed along the guideway substantially reduces capital cost and cost of operation. The extremely low wear or tear of the gliding surfaces in case of an emergency set-down or while using them with maintenance and assembly vehicles moreover yields the benefit of noticeably prolonged maintenance intervals.

BRIEF DESCRIPTION OF THE DRAWINGS

The present invention is explained in more detail based upon the attached drawings of embodiments, wherein.

DETAILED DESCRIPTION OF THE PREFERRED EMBODIMENTS

Figure 1:
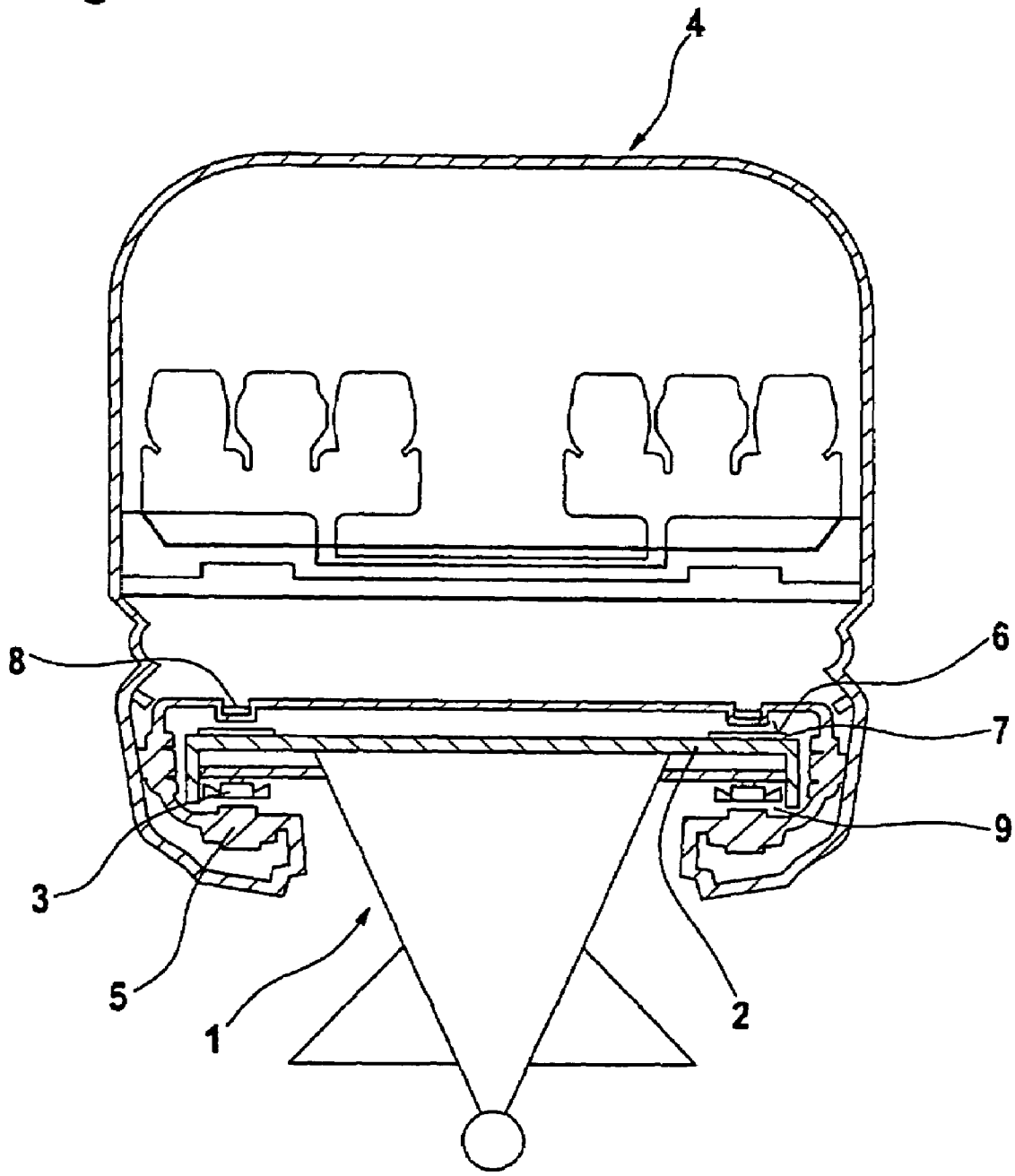
FIG. 1 shows a schematic cross-section through a usual magnetic levitation railway with a guideway carrier and a vehicle.

FIG. 1 shows a schematic cross-section through a magnetic levitation railway with a drive in form of a long-stator linear motor. The magnetic levitation railway is comprised of a plurality of guideway carriers 2 which are arranged one behind the other in the direction of a predetined route and which carry stator packs 3 provided with windings and mounted at the undersides of guideway plates 2. Alongside the guideway carriers 1, the vehicles 4 can ride with carrying magnets 5 which stand opposite to the undersides of stator packs 2 and which simultaneously provide the exciter field for the long-stator linear motor.

At the upper sides of the guideway plates 2, gliding surfaces 6 extending in the direction of travel are provided, which for example are designed as the surfaces of special gliding strips 7 fastened to the guideway plates 2. The gliding surfaces 6 co-act with gliding skids 8 being affixed to the undersides of the vehicles 4 and being supported on the gliding surfaces 6 during a standstill of the vehicles 4 so that there are comparably large gaps 9 between the stator packs 3 and the carrying magnets 5. For a vehicle travel, the carrying magnets 5 are initially activated in order to lift the gliding skids 8 from the gliding surfaces 6 and to adjust the size of the gap 9 to 10 mm, for example, in the suspended status thus established. Subsequently, the vehicle 4 is set in motion.

Magnetic levitation vehicles of this kind are generally known to those skilled in the art (e.g. "Neue Verkehrstechnologien", Henschel Magnetfahrtechnik 6/86).

Figure 2:
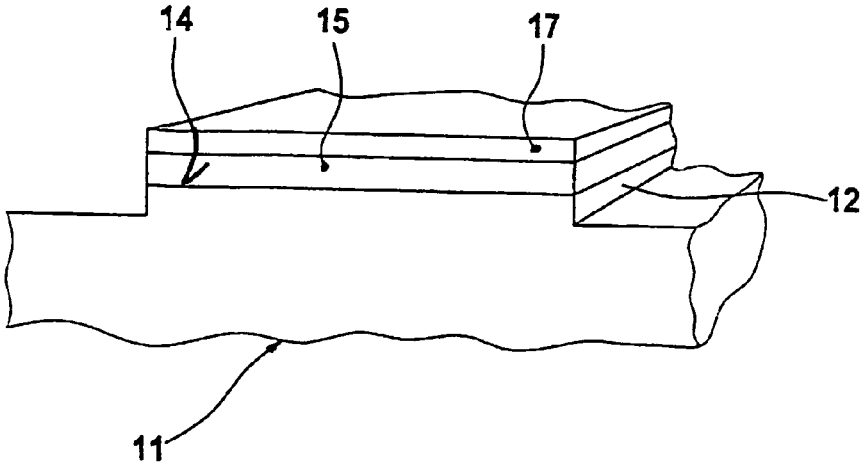
FIG. 2 shows a schematic, perspective partial view of a guideway carrier made of concrete according to the present invention, wherein a gliding surface also made of concrete is provided with an exaggeratedly illustrated coating composed of a ceramic material.

FIG. 2 indicatively shows a guideway carrier 11 which at its upper side is provided with an elevation or strip 12 manufactured with it in a one-piece arrangement provided on its upper side with a gliding surface 14 for the gliding skids 8 of the magnetic levitation vehicle 4 according to FIG. 1. For example, such concrete-type guideway carriers 11 are known from printed publications ZEV-Glas.Ann 105, 1989, page 205-215 or "Magnetbahn Transrapid, die neue Dimension des Reisens", Hestra Verlag Darmstadt 1989, page 21-23 which by reference are hereby made an object of the present disclosure.

While the strips 12 have hitherto been made of concrete like the guideway carriers 11, the gliding surfaces 14 according to the present invention are provided with a coating which contains two layers 15 and 17 that are arranged one above the other. Accordingly, the inner layer 15 is immediately applied on the gliding surface 14, while the layer 17 is configured as an outer layer, so that with guideway beam 11 according to FIG. 2 it is actually the upper surface of the outer layer 17 that would have to be designated as the gliding surface, because normally it is the one and only layer that gets in contact with the gliding skids 8 according to FIG. 1. However, within the purview of the present patent application, it is preferred to designate the surface 14 of the strip 12 as the actual gliding surface and the film composed of layers 15 and 17 as a coating of the gliding surface 14.

In the embodiment according to FIG. 2 it is furthermore envisaged according to the present invention to manufacture the coating at least in the outer area of a low-friction and low-wear ceramic material that is adapted (matched) to the material of the gliding skids 8. It is particularly advantageous for this ceramic material to be composed of an oxide-ceramic material, especially an aluminum oxide ($Al_2O_3$) and titanium dioxide ($TiO_2$) mixture.

Both layers 15 and 17 are preferably provided with a oxide-ceramic material. Accordingly, the inner layer 15 which is applied to the concrete-gliding surface 14 of the guideway carrier 1 is expediently composed of a tenacious and ductile material in order to obtain a good adhesion to concrete and to compensate at least partly for possibly different thermal expansions of the individual constituents. Contrary, the outer layer 17 which forms the gliding pair with the gliding skids 8 is preferably composed of a material having very low wear or tear properties. For this purpose, for example, the first layer 15 can predominantly or exclusively contain a mixture of 50 to 70 percent by mass of aluminum oxide and a remainder of 50 to 30 percent by mass of titanium dioxide, while the outer layer 17, for example, contains at least 90 percent by mass of aluminum oxide and a remainder of up to 10 percent by mass of titanium dioxide.

Figure 3:
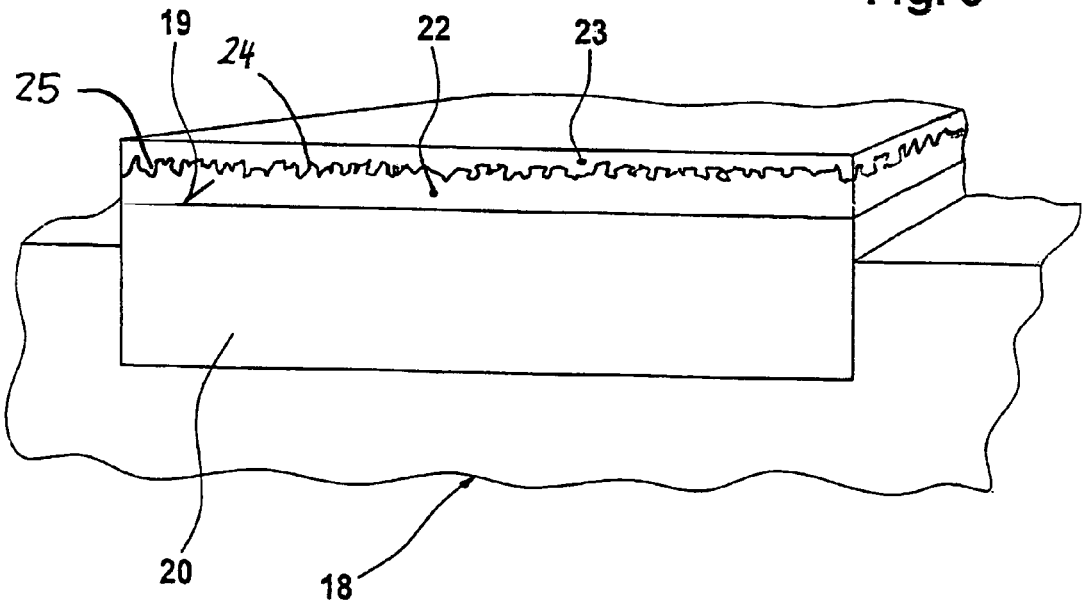
FIG. 3 shows a partial view corresponding to FIG. 2 of a guideway carrier made of concrete according to the present invention, into which carrier a gliding strip made of steel is inserted which is provided with a coating made of ceramic material and an additive.

The embodiment according to FIG. 3 represents a guideway in compound (composite) construction which contains a plurality of guideway carriers 18 made of concrete and arranged one behind the other, wherein gliding strips 20 made of steel and provided with gliding surfaces 19 are inserted into the upper surfaces thereof (e.g. EP-B1-0 381 136). The gliding surfaces 19 in this embodiment protrude a little bit beyond the surface of the remaining guideway carrier 18 and may be provided with a corrosion protection coating in an actually known manner.

According to the invention, a coating is provided in the embodiment according to FIG. 3 which coating contains a mixture of aluminum oxide and titanium dioxide like the one shown in FIG. 2, but moreover at least one additional substance. For this purpose, the coating receives an inner layer 22 configured analogously to layer 15 of FIG. 2. Contrary, the additional substance which in the embodiment of FIG. 3 is a polymeric polyurethane resin, to which for example graphite in a portion of e.g. 20 to 40 percent by mass is admixed as a gliding agent, is applied in form of an outer layer 23.

Furthermore considered in the embodiment of FIG. 3 is the circumstance that the surface of the layer 22 consisting of ceramic material possesses a comparably great roughness, particularly when applied by a thermal spraying process, as schematically indicated in FIG. 3 by roughness peaks 23 and roughness valleys 25. It might involve that the final gliding properties are only obtained after a certain run-in time and after a grinding-off of the roughness tips 24, which is not desired. The polymeric polyurethane resin with graphite as incorporated lubricant and/or gliding agent here serves the purpose of closing and/or sealing the roughness valleys 25 of layer 22 with a tribologically active material. It is achieved thereby that the desired improved frictional and wearing behaviour is obtained immediately after applying the coating. In particular it is avoided that the coating shows a characteristic run-in behaviour, i.e. that a stationary status with a low frictional value is only obtained after a smoothening of the roughness peaks 24 of layer 22 obtained by wear and tear. A special advantage of the embodiment of FIG. 3 moreover lies in the fact that the inner layer 22 is fully functional with regard to the desired wear properties immediately after a degradation of the outer layer 23 caused by wear or tear.

The resin system utilized as additive preferably is a usual system provided by the manufacturer with a tribologically active constituent and being applied onto the gliding surface 19 like layer 22 made of ceramic material by a spraying or rolling process.

To improve adhesion of the inner layers 15, 22 on the gliding surfaces 14, 19 it is expedient to subject these surfaces to a sandblasting treatment, a grinding process or the like in advance in order to roughen them thereby.

The ceramic material is preferably applied by a thermal spraying process onto the gliding surfaces 14, 19. Suitable for this purpose, for example, is the flame spraying and high-speed flame spraying, plasma spraying, detonation spraying, laser spraying, electric arc spraying or cold gas spraying process, preferably utilizing spraying additives in form of powders or wires.

Aluminum oxide or titanium dioxide of various compositions are preferably used as sandwich (laminated materials) for the layers 15, 17 and/or 22 which are composed of or at least predominantly composed of ceramic material. Alternatively, however, other materials on the basis of ceramic materials and/or metallic and non-metallic resin substances as well as mixtures composed of these materials with metallic constituents or plastic material can be utilized which in the scope of the present patent application are generally designated as "ceramic materials". Moreover, these tribologically optimized materials can be applied to all forms of guideway beams as they adhere substantially well to concrete, steel or hybrid structures.

Particularly favourable frictional and wearing properties are moreover achieved through a tribological contact with SiC gliding skid materials. Therefore, two preferred embodiments are described in the following, each of which being optimally adapted to the gliding skid material made of C—CSiC and currently considered the best ones in connection with concrete and/or hybrid guideway carriers. The material concerned here is C—C carbon being reinforced with carbon fibres and being partly brought to react with silicon so that silicon carbide (SiC) is partly formed which gives the required hardness to carbon. The finished gliding skid material can therefore be designated as a carbon ceramic material reinforced with carbon fibres and enriched with SiC.

EXAMPLE 1

A guideway carrier made of concrete according to FIG. 2 is pre-treated with a sandblasting process. Subsequently its gliding surface is coated with a non-metallic hard-material layer made of a mixture composed of $Al_2O_3$ and $TiO_2$. The overall layer is comprised of two individual layers 15 and 19 which are separately applied one after another. The inner layer 15 facing the concrete is comprised of 60% $Al_2O_3$ and 40% $TiO_2$. It has a thickness of 0.3 mm and it is comparably tenacious and ductile. The outer layer 17 which is distinguished by very good wearing properties is 0.3 mm thick, too, and consists of 97% $Al_2O_3$ and 3% $TiO_2$. A flame spraying process is used as the coating process.

The finished coating has a thickness of approximately 0.6 mm and excellent gliding proper-ties while having very little wear, especially if gliding skids 8 are used that are made of the ceramic materials based on C—CSiC and reinforced with carbon fibres as outlined hereinabove.

EXAMPLE 2

The surface of a hybrid guideway beam according to FIG. 3 made of concrete and steel is pre-treated by applying a grinding process. To assure partial compensation for different thermal expansions of the individual structural constituents, a graduated set-up of the coating is realized. As shown in example 1, the inner layer 22 facing the guideway carrier and being 0.4 mm thick consists of 60% $Al_2O_3$ and 40% $TiO_2$. Flame spraying is again applied as the coating process. A 0.3 mm thick coating based on a polymeric PU resin containing 30% graphite is applied to serve as the outer layer 23.

The finished coating has a thickness of approximately 0.7 mm and excellent gliding properties. The hard solid layer remaining upon abrasion of the outer polyurethane resin layer 23 has a high resistance to wear and good, instantly available gliding properties. This is valid in particular because the roughness valleys 25 have been filled with polyurethane resin or the like and because the roughness peaks 24, therefore, have no significant influence on the desired low resistance to friction. Particularly favourable conditions are obtained in connection with the gliding skids 8 made of the C—CSiC-based ceramic material reinforced with carbon fibres as outlined hereinabove.

The advantage achieved by means of the examples 1 and 2 is that the coefficient of gliding friction of the tribological pair of gliding surface and gliding skid is drastically reduced and that the resistance to wear of this pair increases by the tenfold. Moreover, excellent adhesive strength of the coating in total is thereby achieved.

The invention is not limited to the embodiments described herein that can be varied in a plurality of ways. In particular this applies to the structure of the guideway carrier existing in an individual case, which apart from the described concrete and/or compound-type structures may also be a guideway structure entirely composed of steel. Moreover, the term "guideway carrier" as used within the scope of the present invention covers all structures suitable for the manufacture of guideways for magnetic levitation vehicles of the type described hereunder (beam, plate and module structures and the like), irrespective of whether the gliding surfaces 14, 19 are provided at elevations of concrete beams or at specific gliding strips made of steel or concrete and connected by welding, bolting or in any other way together with other components to a finished guideway carrier or simply consists of substantially even surfaces of a concrete, compound-type or steel carrier. Furthermore it is clear that the coating materials indicated hereunder as examples can also be replaced entirely or partly with other materials having the corresponding properties, that other portions of the additive in layer 23 of FIG. 3 can be applied and that thicknesses other than those described hereunder can be chosen for the different layers, giving preference to thicknesses of maximally 1 mm in total. For example, a material based on epoxy or acrylate resin could alternatively be used as matrix material for the outer layer 23. Moreover it is expedient to manufacture the gliding surfaces 14, 19 each with a certain undersize so as to obtain the demanded tong size (guideway depth) between the surface of the coating and the undersides of the stator packs 3 after coating. Alternatively, the increase in the tong size caused by the coating could also be compensated by a corresponding alteration of the gliding skids 8. Finally, it is self-explanatory that the different features can also be applied in combinations other than those described and shown hereinabove.

The invention claimed is:

1. A guideway carrier with a sliding surface (14, 19) for magnetically levitated vehicles (4) having at least one sliding skid (8) for being set-down onto said sliding surface (14, 19) during a standstill or in the vent of emergency during travel of the vehicle (4), wherein said sliding surface (14, 19) is provided with a coating (15, 17; 21, 23) comprising a tribologically active material having low friction and wear if combined with a sliding skid material of said sliding skid (8) such that an immediate braking of the vehicle (4) is avoided when the sliding skid (8) is set down onto said sliding surface (14, 19) during travel of the vehicle (4) adapted to the gliding skid material, characterized in that said coating is provided by a ceramic material.

2. A guideway carrier according to claim 1, wherein the ceramic material predominantly comprises an oxide-ceramic material.

3. A guideway carrier according to claim 1, wherein the ceramic material substantially consists of aluminum oxide and/or titanium dioxide.

4. A guideway carrier according to claim 1, wherein the coating comprises the ceramic material and at least one additive.

5. A guideway carrier according to claim 4, wherein the additive is a polymeric polyurethane resin with graphite acting as a gliding agent.

6. A guideway carrier according to claim 1, wherein said coating is set-up in a graduated configuration.

7. A guideway carrier according to claim 1, wherein the coating has several layers including an inner layer (15) comprised of a mixture composed of 50 to 70 percent by mass of aluminum oxide and as the remainder of titanium dioxide and a second outer layer (17) lying on said layer (15) and consisting of a mixture comprised of at least 90 percent by mass of aluminum oxide and as the remainder of titanium dioxide.

8. A guideway carrier according to claim 1, wherein the coating has several layers including an inner layer (22) comprised of a mixture composed of 50 to 70 percent by mass of aluminum oxide and as the remainder of titanium dioxide and a second outer layer (23) lying on said layer (22) and comprising a polymeric polyurethane resin having 20 to 40 percent by mass of graphite.

9. A guideway carrier according to claim 1, wherein said coating has a thickness of 1 mm maximum.

10. A guideway carrier according to claim 1, wherein the coating has several layers including an inner layer (15, 22) with a thickness of 0.2 mm to 0.5 mm.

11. A guideway carrier according to claim 1, wherein the coating has several layers including an outer layer (17, 23) which has a thickness of 0.2 mm to 0.4 mm.

12. A guideway carrier according to claim 1, wherein the sliding surface (14, 19) is roughened before the coating is applied.

13. A magnetic levitation railway with a guideway provided with a sliding surface (14, 19) and at least one magnetically levitated vehicle (4) having at least one sliding skid (8) for being set-down onto said sliding surface (14, 19) during a standstill or in the event of emergency during travel of the vehicle (4), said sliding skid (8) being composed of a carbon fiber-reinforced carbon enriched with SiC, wherein said sliding surface (14, 19) is provided with a coating (15, 17; 21, 23) comprising a tribulogically active ceramic material having low friction and wear if combined with said sliding skid material such that an immediate braking of the vehicle is avoided when the sliding skid (8) is set down onto said sliding surface (14, 19) during travel of the vehicle (4).

* * * * *